US008671714B2

(12) United States Patent
Kondou

(10) Patent No.: US 8,671,714 B2
(45) Date of Patent: Mar. 18, 2014

(54) HEAT EXCHANGER UNIT

(75) Inventor: Yasuhiro Kondou, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 689 days.

(21) Appl. No.: 12/937,998

(22) PCT Filed: Apr. 20, 2009

(86) PCT No.: PCT/JP2009/001790
§ 371 (c)(1),
(2), (4) Date: Oct. 15, 2010

(87) PCT Pub. No.: WO2009/130876
PCT Pub. Date: Oct. 29, 2009

(65) Prior Publication Data

US 2011/0030403 A1 Feb. 10, 2011

(30) Foreign Application Priority Data

Apr. 21, 2008 (JP) ..... 2008-109787

(51) Int. Cl.
*F25B 39/02* (2006.01)

(52) U.S. Cl.
USPC ..... 62/504; 62/515; 165/167

(58) Field of Classification Search
USPC ..... 62/504, 515, 160, 196.4, 198; 165/167, 165/174, 17
See application file for complete search history.

(56) References Cited

U.S. PATENT DOCUMENTS 4,939,910 A * 7/1990 Umezu et al. ..... 62/160
5,979,547 A * 11/1999 Shinmura et al. ..... 165/174

FOREIGN PATENT DOCUMENTS

| | | | | |
|---|---|---|---|---|
| JP | 7-269971 | A | | 10/1995 |
| JP | 10-205919 | A | | 8/1998 |
| JP | 2000-180076 | A | | 6/2000 |
| JP | 2000-356483 | A | | 12/2000 |
| JP | 2001-147051 | A | | 5/2001 |
| JP | 2001133112 | A | * | 5/2001 |
| JP | 2001-201227 | A | | 7/2001 |
| JP | 2002-62082 | A | | 2/2002 |
| JP | 2003-287321 | A | | 10/2003 |
| JP | 2005-337688 | A | | 12/2005 |

OTHER PUBLICATIONS

International Search Report of corresponding PCT Application No. PCT/JP2009/001790.
International Preliminary Report of corresponding PCT Application No. PCT/JP2009/001790.

* cited by examiner

*Primary Examiner* — Cheryl J Tyler
*Assistant Examiner* — Ana Vazquez
(74) *Attorney, Agent, or Firm* — Global IP Counselors

(57) ABSTRACT

A heat exchanger unit includes first and second plate heat exchangers disposed in series along a refrigerant flow direction. A refrigerant flows from the first plate heat exchanger to the second plate heat exchanger when the heat exchanger unit operates as an evaporator to heat the refrigerant, and the refrigerant flows from the second plate heat exchanger to the first plate heat exchanger when the heat exchanger unit operates as a condenser to cool the refrigerant. The first and second plate heat exchangers have first and second gas-liquid mixing structures to promote gas-liquid mixing of the refrigerant when the heat exchanger unit heats the refrigerant. The first and second gas-liquid mixing structures are configured such that pressure loss becomes larger when the gas-liquid mixing action becomes higher and such that the gas-liquid mixing action of the first gas-liquid mixing structure is higher than the gas-liquid mixing action of the second gas-liquid mixing structure.

6 Claims, 4 Drawing Sheets

HEAT EXCHANGER UNIT

CROSS-REFERENCE TO RELATED APPLICATIONS

This U.S. National stage application claims priority under 35 U.S.C. §119(a) to Japanese Patent Application No. 2008-109787, filed in Japan on Apr. 21, 2008, the entire contents of which are hereby incorporated herein by reference.

TECHNICAL FIELD

The present invention relates to a heat exchanger unit configured by interconnecting plural plate heat exchangers in series.

BACKGROUND ART

Conventionally, technologies by which a heat exchanger unit with a compact configuration is obtained by interconnecting multiple small plate heat exchangers in series have been known (e.g., see Japanese Patent Publication Nos. 2000-180076, 2000-356483 and 2005-337688).

In a heat exchanger unit with this configuration, particularly when this heat exchanger unit functions as an evaporator, the state of the refrigerant that flows therethrough changes such that the ratio of gas regions in the refrigerant gradually becomes higher as the refrigerant flows into the plate heat exchangers in a gas-liquid mixed state and travels to the plate heat exchanger on the downstream side.

Further, in the individual plate heat exchangers, the more liquid regions there are in the refrigerant, the more the refrigerant distribution performance with respect to each of the refrigerant flow paths inside drops, and sites where the heat exchange efficiency is high and sites where the heat exchange efficiency is low arise in the plate heat exchangers, so that the overall heat exchange efficiency drops.

Consequently, in order to improve the coefficient of performance of the heat exchanger unit overall, it is necessary to consider both the pressure loss and the refrigerant distribution performance in each of the plate heat exchangers.

From this standpoint, in patent citation 3, there is proposed a technology where a heat exchanger with the required capacity is configured by interconnecting two small plate heat exchangers in series. The heat exchanger is configured such that a distribution pipe to each of the refrigerant flow paths is disposed in the plate heat exchanger on the upstream side to ensure refrigerant distributivity, because there are many liquid regions in the refrigerant flowing into the plate heat exchanger on the upstream side and the distributivity of the refrigerant to each of the refrigerant flow paths is poor, and such that a distribution pipe is not disposed in the plate heat exchanger on the downstream side because there are many gas regions in the refrigerant flowing into the plate heat exchanger on the downstream side and the distributivity of the refrigerant is good.

According to this, in the plate heat exchanger on the upstream side, the pressure loss becomes large because of the presence of the distribution pipe, but the distributivity of the refrigerant improves because of the gas-liquid mixing action in the distribution pipe. Further, in the plate heat exchanger on the downstream side, the distributivity of the refrigerant is good because there are many gas regions, and the pressure loss is also small because there is no distribution pipe. Because of these synergistic effects, the coefficient of performance of the heat exchanger overall is improved.

SUMMARY

Technical Problem

However, because the state of the refrigerant differs in each of the individual plate heat exchangers as described above and also changes depending on the operating state, the configuration described in patent citation 3 listed above cannot alone sufficiently respond to such changes in the state of the refrigerant.

Thus, the present invention has been made with the object of improving the coefficient of performance of the heat exchanger unit overall with a simple and inexpensive configuration by considering the pressure loss and the refrigerant distribution performance in each of the plural plate heat exchangers.

Solution to the Problem

In the present invention, the following configurations are employed as specific means for solving this problem.

A heat exchanger unit pertaining to a first aspect of the present invention is a heat exchanger unit comprising a first plate heat exchanger and a second plate heat exchanger that is disposed in series in a predetermined flow direction of the first plate heat exchanger, with the heat exchanger unit being placed such that, when the heat exchanger unit works as an evaporator to heat a refrigerant, the refrigerant flows from the first plate heat exchanger to the second plate heat exchanger, and when the heat exchanger unit works as a condenser to cool the refrigerant, the refrigerant flows from the second plate heat exchanger to the first plate heat exchanger, wherein the first plate heat exchanger has a plurality of first refrigerant flow paths, a first lower header portion and a first upper header portion for distributing and collecting the refrigerant that flows to the plurality of first refrigerant flow paths and causing the refrigerant to flow in the predetermined flow direction, and a first gas-liquid mixing structure or means to promote gas-liquid mixing of the refrigerant in the first lower header portion when the heat exchanger unit heats the refrigerant, the second plate heat exchanger has a plurality of second refrigerant flow paths, a second lower header portion and a second upper header portion for distributing and collecting the refrigerant that flows to the plurality of second refrigerant flow paths and causing the refrigerant to flow in the predetermined flow direction, and a second gas-liquid mixing structure or means to promote gas-liquid mixing of the refrigerant in the second lower header portion when the heat exchanger unit heats the refrigerant, and the first gas-liquid mixing means and the second gas-liquid mixing means are means in which the pressure loss becomes larger the higher the gas-liquid mixing action becomes and are set such that the gas-liquid mixing action of the first gas-liquid mixing means is higher than the gas-liquid mixing action of the second gas-liquid mixing means.

A heat exchanger unit pertaining to a second aspect of the present invention is the heat exchanger unit pertaining to the first aspect of the present invention, wherein the first plate heat exchanger has, as the first gas-liquid mixing means, a plurality of first refrigerant inflow ports that are disposed in connecting portions between the plurality of first refrigerant flow paths and the first lower header portion, the second plate heat exchanger has, as the second gas-liquid mixing means, a plurality of second refrigerant inflow ports that are disposed in connecting portions between the plurality of second refrigerant flow paths and the second lower header portion, and the first plate heat exchanger and the second plate heat exchanger are set such that the first refrigerant inflow ports have smaller diameters than the second refrigerant inflow ports.

A heat exchanger unit pertaining to a third aspect of the present invention is the heat exchanger unit pertaining to the second aspect of the present invention, further comprising a third plate heat exchanger that is disposed in series in the predetermined flow direction of the second plate heat exchanger, wherein the third plate heat exchanger has a plurality of third refrigerant flow paths, a third lower header portion and a third upper header portion for distributing and collecting the refrigerant that flows to the plurality of third refrigerant flow paths and causing the refrigerant to flow in the predetermined flow direction, and a plurality of third refrigerant inflow ports that are disposed in connecting portions between the plurality of third refrigerant flow paths and the third lower header portion as a third gas-liquid mixing structure or means, and the first plate heat exchanger, the second plate heat exchanger, and the third plate heat exchanger are set such that the first refrigerant inflow ports have smaller diameters than the second refrigerant inflow ports and such that the second refrigerant inflow ports have smaller diameters than the third refrigerant inflow ports.

A heat exchanger unit pertaining to a fourth aspect of the present invention is the heat exchanger unit pertaining to the first aspect of the present invention, wherein the first plate heat exchanger has, as the first gas-liquid mixing means, a first orifice for adjustment of the refrigerant that flows into the first lower header portion, the second plate heat exchanger has, as the second gas-liquid mixing means, a second orifice for adjustment of the refrigerant that flows into the second lower header portion from the first plate heat exchanger, and the first plate heat exchanger and the second plate heat exchanger are set such that the amount of restriction of the first orifice becomes larger than the amount of restriction of the second orifice.

A heat exchanger unit pertaining to a fifth aspect of the present invention is the heat exchanger unit pertaining to the first aspect of the present invention, wherein the first plate heat exchanger has, as the first gas-liquid mixing means, a plurality of first refrigerant inflow ports that are disposed in connecting portions between the plurality of first refrigerant flow paths and the first lower header portion, the second plate heat exchanger has an orifice for adjustment of the refrigerant that flows into the second lower header portion, and the first plate heat exchanger and the second plate heat exchanger are set such that the degree of restriction of the first refrigerant inflow ports becomes larger than the degree of restriction of the orifice.

A heat exchanger unit pertaining to a sixth aspect of the present invention is the heat exchanger unit pertaining to any of the first to fifth aspects of the present invention, further comprising a bypass conduit for bypassing the first plate heat exchanger, wherein the bypass conduit does not bypass the first plate heat exchanger when the heat exchanger unit functions as an evaporator and the bypass conduit bypasses the first plate heat exchanger when the heat exchanger unit functions as a condenser.

Advantageous Effects of the Invention

In the present invention, the following effects are obtained.

(a) According to the heat exchanger unit pertaining to the first aspect of the present invention, the refrigerant in the first lower header portion is mixed by the first gas-liquid mixing means of the first plate heat exchanger, so when the first lower header portion distributes the refrigerant to the plural first refrigerant flow paths, the first lower header portion can cause refrigerant where the mixing ratio of liquid refrigerant and gas refrigerant is the same ratio to flow to each of the first refrigerant flow paths. Further, the refrigerant in the second lower header portion is mixed by the second gas-liquid mixing means of the second plate heat exchanger, so when the second lower header portion distributes the refrigerant to the plural second refrigerant flow paths, the second lower header portion can cause refrigerant where the mixing ratio of liquid refrigerant and gas refrigerant is the same ratio to flow to each of the second refrigerant flow paths.

In this case, when the heat exchanger unit functions as an evaporator, the ratio of liquid refrigerant is larger in the first plate heat exchanger than in the third plate heat exchanger, so appropriate equal distribution is realized in the first plate heat exchanger as a result of the first gas-liquid mixing means exhibiting a higher gas-liquid mixing action than the second gas-liquid mixing means, and the performance of equal distribution is also improved in the second plate heat exchanger. On the other hand, when the heat exchanger unit functions as a condenser, the pressure loss overall is kept low by making the pressure loss in the second gas-liquid mixing means of the second plate heat exchanger, where the ratio of gas refrigerant becomes larger, smaller than the pressure loss in the first gas-liquid mixing means of the first plate heat exchanger.

Thus, a high coefficient of performance is ensured in the heat exchanger unit overall. Therefore, the merit of making the heat exchanger unit compact by interconnecting the plural plate heat exchangers in series in the predetermined flow direction to configure the heat exchanger unit is used to maximum advantage.

(b) According to the heat exchanger unit pertaining to the second aspect of the present invention, the following specific effect is obtained in addition to the effect described in (a). That is, adjustment of the distribution function and the pressure loss between each of the plate heat exchangers can be performed with the simple configuration of adjusting the diameters of the plural first refrigerant inflow ports of the first plate heat exchanger and the plural second refrigerant inflow ports of the second plate heat exchanger, and a heat exchanger unit whose coefficient of performance is high can be realized simply.

(c) According to the heat exchanger unit pertaining to the third aspect of the present invention, the following specific effect is obtained in addition to the effect described in (a). That is, the third gas-liquid mixing means (the plural third refrigerant inflow ports) of the third plate heat exchanger is added in addition to the first gas-liquid mixing means of the first plate heat exchanger and the second gas-liquid mixing means of the second plate heat exchanger, so when three or more plate heat exchangers are interconnected, a further improvement in the coefficient of performance can be made.

(d) According to the heat exchanger unit pertaining to the fourth aspect of the present invention, the following specific effect is obtained in addition to the effect described in (a). That is, adjustment of the distribution function and the pressure loss between each of the plate heat exchangers can be performed with the simple configuration of adjusting the amounts of restriction of the first orifice of the first plate heat exchanger and the second orifice of the second plate heat exchanger, and a heat exchanger unit whose coefficient of performance is high can be realized simply.

(e) According to the heat exchanger unit pertaining to the fifth aspect of the present invention, the following specific effect is obtained in addition to the effect described in (a). That is, adjustment of the distribution function and the pressure loss between each of the plate heat exchangers can be performed with the simple configuration of adjusting the degrees of restriction of the plural first refrigerant inflow ports of the first plate heat exchanger and the orifice of the second plate heat exchanger, and a heat exchanger unit whose coefficient of performance is high can be realized simply.

(f) According to the heat exchanger unit pertaining to the sixth aspect of the present invention, the following specific effect is obtained in addition to the effects described in any of (a) to (e). That is, when the heat exchanger unit functions as a condenser, the pressure loss of the refrigerant becomes larger in correspondence to the refrigerant distribution function being set high toward the refrigerant most-downstream side, so sometimes the coefficient of performance of the heat exchanger unit overall can be improved by using the bypass conduit to bypass the flow of the refrigerant into the first plate heat exchanger, where the pressure loss is large, when the heat exchanger unit functions as a condenser.

DESCRIPTION OF THE EMBODIMENTS

The present invention will be specifically described below on the basis of preferred embodiments.

I: First Embodiment

Figure 1:
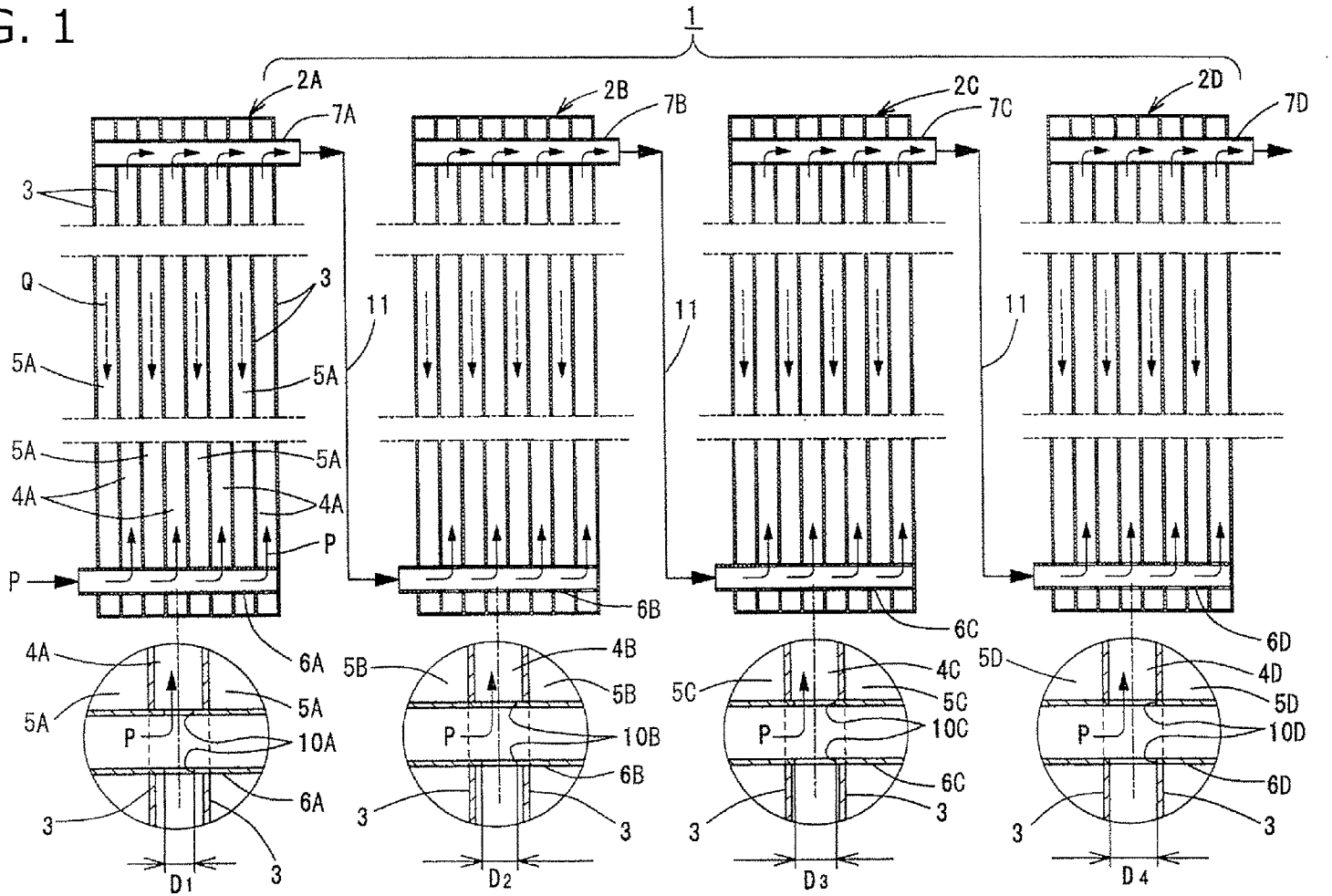
FIG. 1 is an explanatory diagram showing the structure of a heat exchanger unit pertaining to a first embodiment of the present invention.

FIG. 1 shows a heat exchanger unit 1 pertaining to a first embodiment of the present invention. This heat exchanger unit 1 is used as a utilization-side heat exchanger of a water-cooled chiller unit and is configured as a result of four plate heat exchangers 2A to 2D being connected sequentially in series by connection conduits 11.

I-a: Configuration of Plate Heat Exchangers

Here, the structure of the plate heat exchangers will be described taking as an example the first plate heat exchanger 2A, which is positioned on the refrigerant most-upstream side when the heat exchanger unit 1 functions as an evaporator.

This plate heat exchanger 2A is configured by stacking numerous heat transfer plates 3 a predetermined interval apart from each other, with the plural passages that are adjacent via each of these heat transfer plates 3 being alternately used as refrigerant flow paths 4A and water flow paths 5A.

A lower header portion 6A and an upper header portion 7A configured by pipe bodies extending through each of the passages 4A and 5A are disposed on the downstream end side and on the upstream end side of this plate heat exchanger 2A. Additionally, refrigerant inflow ports 10A are formed in the pipe walls of the lower header portion 6A and the upper header portion 7A corresponding to the refrigerant flow paths 4A, and the lower header portion 6A and the upper header portion 7A are fluidically communicated with the refrigerant flow paths 4A via the refrigerant inflow ports 10A.

Each of the water flow paths 5 is also fluidically communicated with upper-and-lower pairs of header portions (not shown) having the same structure.

Here, the basic configuration of each of the plate heat exchangers 2A to 2D is the same. The plate heat exchanger 2B is equipped with plural refrigerant flow paths 4B, plural water flow paths 5B, a lower header portion 6B, an upper header portion 7B, and refrigerant inflow ports 10B. The plate heat exchanger 2C is equipped with plural refrigerant flow paths 4C, plural water flow paths 5C, a lower header portion 6C, an upper header portion 7C, and refrigerant inflow ports 10C. The plate heat exchanger 2D is equipped with plural refrigerant flow paths 4D, plural water flow paths 5D, a lower header portion 6D, an upper header portion 7D, and refrigerant inflow ports 10D.

However, the diameters of the refrigerant inflow ports 10A to 10D differ. That is, D1 is the diameter of the refrigerant inflow ports 10A disposed in the first plate heat exchanger 2A, which is positioned on the refrigerant most-upstream side when the heat exchanger unit 1 functions as an evaporator. D2 is the diameter of the refrigerant inflow ports 10B disposed in the second plate heat exchanger 2B, which is second from the refrigerant most-upstream side. D3 is the diameter of the refrigerant inflow ports 10C disposed in the third plate heat exchanger 2C, which is third from the refrigerant most-upstream side. Moreover, D4 is the diameter of the refrigerant inflow ports 10D disposed in the fourth plate heat exchanger 2D, which is positioned on the most-downstream side. These diameters have the magnitude relation of D1<D2<D3<D4.

In this embodiment, the refrigerant inflow ports 10D of the fourth plate heat exchanger 2D are set to a diameter that is the same as the width dimension of the refrigerant flow paths 4D. Consequently, the particular function relating to refrigerant distribution of restricting refrigerant is not given to these refrigerant inflow ports 10D.

I-b: Operation of Heat Exchanger Unit 1

I-b-1: When Used as an Evaporator

In this case, as shown in FIG. 1, a refrigerant P flows into the first plate heat exchanger 2A from the lower header portion 6A side thereof, travels through each of the refrigerant flow paths 4A, flows out from the upper header portion 7A, and flows into the lower header portion 6B of the second plate heat exchanger 2B via the connection conduit 11. The refrigerant P repeats this flow configuration from the second plate heat exchanger 2B to the third plate heat exchanger 2C and then to the fourth plate heat exchanger 2D until it finally flows out from the upper header portion 7D of the fourth plate heat exchanger 2D to a condenser (not shown) side.

Meanwhile, conversely from the flow of the refrigerant P, water Q flows into the fourth plate heat exchanger 2D from the upper header portion (not shown) thereof, travels through each of the water flow paths 5, flows out from the lower header portion (not shown), and flows into the upper header portion side of the third plate heat exchanger 2C via a connection conduit (not shown). The water Q repeats this flow configuration from the third plate heat exchanger 2C to the second plate heat exchanger 2B and then to the first plate heat exchanger 2A until it finally flows out from the lower header portion of the first plate heat exchanger 2A.

Consequently, in each of the plate heat exchangers 2A to 2D, the refrigerant P flowing inside the refrigerant flow paths 4A to 4D and the water Q flowing inside the water flow paths 5A to 5D are counterflows, and heat exchange is performed between the refrigerant P and the water Q via the heat transfer plates 3. Additionally, the refrigerant P progressively evaporates as a result of being subjected to the heating action resulting from the heat exchange with the water Q in each of the plate heat exchangers 2A to 2D, changes from a gas-liquid two-phase refrigerant where the ratio of liquid refrigerant is large to a gas-liquid two-phase refrigerant where the ratio of gas refrigerant is large, and flows out from the heat exchanger unit 1.

Further, the water Q is cooled by the heat exchange with the refrigerant P in each of the plate heat exchangers 2A to 2D of the heat exchanger unit 1, flows out from the heat exchanger unit 1 as cold water, and is utilized as a heat source for cooling the inside of a room, for example.

Here, the distributivity of the refrigerant P in each of the plate heat exchangers 2A to 2D of the heat exchanger unit 1 will be considered.

As described above, the refrigerant P flows into the first plate heat exchanger 2A on the most-upstream side as a gas-liquid two-phase refrigerant where the ratio of liquid refrigerant is large, travels to the fourth plate heat exchanger 2D on the most-downstream side while progressively evaporating, and flows out from the fourth plate heat exchanger 2D as a gas-liquid two-phase refrigerant where the ratio of gas refrigerant is large. Consequently, the state of the refrigerant in each of the plate heat exchangers 2A to 2D differs. For this reason, for example, when the diameters of the refrigerant inflow ports 10A to 10D in each of the plate heat exchangers 2A to 2D are set the same, so that, for example, the diameters of these refrigerant inflow ports 10A to 10D are set in consideration of the distributivity of the refrigerant in the first plate heat exchanger 2A through which flows a gas-liquid two-phase refrigerant where the ratio of liquid refrigerant is large, then on the fourth plate heat exchanger 2D side through which flows a gas-liquid two-phase refrigerant where the ratio of gas refrigerant is large, the passage area becomes extremely small in proportion to the flow rate and the pressure loss becomes larger. Conversely, when the diameters of the refrigerant inflow ports 10A to 10D are set in consideration of the distributivity of the refrigerant in the fourth plate heat exchanger 2D, then on the first plate heat exchanger 2A side through which flows a gas-liquid two-phase refrigerant where the ratio of liquid refrigerant is large, the passage area becomes extremely large with respect to the refrigerant flow rate, gas-liquid mixing of the refrigerant is not sufficiently achieved, and the distributivity of the refrigerant becomes impaired. Both of these cases lead to a drop in the coefficient of performance of the heat exchanger unit 1 and are not preferable.

In contrast, in the heat exchanger unit 1 of this embodiment, as described above, the diameters of the refrigerant inflow ports 10A to 10D are set such that they sequentially become larger from the first plate heat exchanger 2A to the fourth plate heat exchanger 2D, so optimum refrigerant distributivity is obtained in each of the plate heat exchangers 2A to 2D. As a result, the coefficient of performance of the heat exchanger unit 1 overall improves.

That is, in the first plate heat exchanger 2A, a gas-liquid two-phase refrigerant where the ratio of liquid refrigerant is the largest flows in from the lower header portion 6A side, but because the diameter of the refrigerant inflow ports 10A disposed in the lower header portion 6A is small, the refrigerant P that travels from the lower header portion 6A through the refrigerant inflow ports 10A and flows into each of the refrigerant flow paths 4A becomes equalized as a result of being subjected to a strong gas-liquid mixing action when the refrigerant P flows in from the refrigerant inflow ports 10A, and heat exchange with the water Q while the refrigerant P flows through the refrigerant flow paths 4A is promoted. In other words, the refrigerant inflow ports 10A are parts of a gas-liquid mixing structure or means.

Evaporation of the refrigerant P progresses while the refrigerant P travels from the first plate heat exchanger 2A to the second plate heat exchanger 2B, the third plate heat exchanger 2C, and then to the fourth plate heat exchanger 2D on the most-downstream side. The ratio of gas refrigerant in the refrigerant P gradually increases, the flow rate of the refrigerant P increases because of the increase in the volume of the refrigerant P, and inherently the pressure loss tends to increase as the volume of the refrigerant P increases.

However, in this embodiment, an increase in the pressure loss is suppressed because the diameters of the refrigerant inflow ports 10A to 10D become larger from the second plate heat exchanger 2B to the third plate heat exchanger 2C and then to the fourth plate heat exchanger 2D on the most-downstream side. Moreover, the ratio of gas refrigerant in the refrigerant P is large, and the distributivity of the refrigerant P to each of the refrigerant flow paths 4 of each of the plate heat exchangers 2B to 2D is maintained high.

Because of these synergistic effects, the coefficient of performance of the heat exchanger unit 1 overall improves when the heat exchanger unit 1 is used as an evaporator.

I-b-2: When Used as a Condenser

In this case, the refrigerant P flows in the opposite direction of the flow direction shown in FIG. 1. That is, the refrigerant P flows into the fourth plate heat exchanger 2D from the upper header portion 7D side thereof, travels through each of the refrigerant flow paths 4D, flows out from the lower header portion 6D, and flows into the upper header portion 7C of the third plate heat exchanger 2C via the connection conduit 11. The refrigerant P repeats this flow configuration from the third plate heat exchanger 2C to the second plate heat exchanger 2B and then to the first plate heat exchanger 2A until it finally flows out from the lower header portion 6A of the first plate heat exchanger 2A.

Meanwhile, conversely from the flow of the refrigerant P, the water Q flows into the first plate heat exchanger 2A from the lower header portion (not shown) thereof, travels through each of the water flow paths 5, flows out from the upper header portion (not shown), and flows into the lower header portion side of the second plate heat exchanger 2B via the connection conduit (not shown). The water Q repeats this flow configuration from the second plate heat exchanger 2B to the third plate heat exchanger 2C and then to the fourth plate heat exchanger 2D until it finally flows out from the upper header portion of the fourth plate heat exchanger 2D.

Consequently, in each of the plate heat exchangers 2D to 2A, the refrigerant P flowing inside the refrigerant flow paths 4D to 4A and the water Q flowing inside each of the water flow paths 5D to 5A are counterflows, and heat exchange is performed between the refrigerant P and the water Q via the heat transfer plates 3. Additionally, the refrigerant P progressively condenses as a result of being subjected to the cooling action resulting from the heat exchange with the water Q in each of the plate heat exchangers 2D to 2A, changes from a gas-liquid two-phase refrigerant where the ratio of gas refrigerant is large to a gas-liquid two-phase refrigerant where the ratio of liquid refrigerant is large, and flows out from the heat exchanger unit 1.

Further, the water Q is heated by the heat exchange with the refrigerant P in each of the plate heat exchangers 2A to 2D of the heat exchanger unit 1, flows out from the heat exchanger unit 1 as hot water, and is utilized as a heat source for heating the inside of a room, for example.

Here, the pressure loss of the refrigerant P in each of the plate heat exchangers 2D to 2A of the heat exchanger unit 1 will be considered.

As described above, the refrigerant P flows into the fourth plate heat exchanger 2D on the most-upstream side as a gas-liquid two-phase refrigerant where the ratio of gas refrigerant is large, travels to the first plate heat exchanger 2A on the most-downstream side while progressively condensing, and flows out from the first plate heat exchanger 2A as a gas-liquid two-phase refrigerant where the ratio of liquid refrigerant is large. Consequently, the state of the refrigerant in each of the plate heat exchangers 2D to 2A differs. For this reason, for example, when the diameters of the refrigerant inflow ports 10D to 10A in each of the plate heat exchangers 2D to 2A are set the same, so that, for example, the diameters of these refrigerant inflow ports 10D to 10A are set in consideration of the pressure loss of the refrigerant in the first plate heat exchanger 2A through which flows a gas-liquid two-phase refrigerant where the ratio of liquid refrigerant is large, then on the fourth plate heat exchanger 2D side through which flows a gas-liquid two-phase refrigerant where the ratio of gas refrigerant is large, the passage area becomes extremely small in proportion to the flow rate and the pressure loss becomes larger. Conversely, when the diameters of the refrigerant inflow ports 10D to 10A are set in consideration of the pressure loss of the refrigerant in the fourth plate heat exchanger 2D, then on the first plate heat exchanger 2A side through which flows a gas-liquid two-phase refrigerant where the ratio of liquid refrigerant is large, the passage area becomes extremely large with respect to the refrigerant flow rate, so even though the pressure loss becomes smaller, gas-liquid mixing of the refrigerant is not sufficiently achieved. Both of these cases lead to a drop in the coefficient of performance of the heat exchanger unit 1 and are not preferable. This problem is the same as when the heat exchanger unit 1 is used as an evaporator.

In contrast, in the heat exchanger unit 1 of this embodiment, as described above, the diameters of the refrigerant inflow ports 10A to 10D are set such that they sequentially become larger from the first plate heat exchanger 2A to the fourth plate heat exchanger 2D (in other words, such that they sequentially become smaller from the fourth plate heat exchanger 2D to the first plate heat exchanger 2A), so the pressure loss is reduced in each of the plate heat exchangers 2D to 2A. As a result, the coefficient of performance of the heat exchanger unit 1 overall improves.

That is, in the fourth plate heat exchanger 2D, a gas-liquid two-phase refrigerant where the ratio of gas refrigerant is the largest flows in from the lower header portion 7D side, but because the diameter of the refrigerant inflow ports 10D disposed in the fourth plate heat exchanger 2D is the largest, the refrigerant P that travels from the upper header portion 7D through the refrigerant inflow ports 10D and flows into each of the refrigerant flow paths 4D easily becomes equalized virtually without being subjected to a gas-liquid mixing action resulting from restriction when the refrigerant P flows in from the refrigerant inflow ports 10D, and heat exchange with the water Q while the refrigerant P flows through each of the refrigerant flow paths 4D is promoted. Further, because the refrigerant P is virtually not subjected to a restriction action, the pressure loss in the fourth plate heat exchanger 2D is also kept as small as possible.

Condensation of the refrigerant P progresses while the refrigerant P travels from the fourth plate heat exchanger 2D to the third plate heat exchanger 2C, the second plate heat exchanger 2B, and then to the first plate heat exchanger 2A on the most-downstream side. The ratio of liquid refrigerant in the refrigerant P gradually increases, and the flow rate of the refrigerant P decreases because of the decrease in the volume of the refrigerant P. However, in each of the heat exchangers 2D to 2A, the pressure loss is kept low and gas-liquid mixing of the refrigerant P is promoted because, in correspondence to this decrease in the flow rate, the diameters of the refrigerant inflow ports 10C to 10A are set such that they become smaller from the third plate heat exchanger 2C to the second plate heat exchanger 2B and then to the first plate heat exchanger 2A on the most-downstream side. As a result, the coefficient of performance of the heat exchanger unit 1 overall improves.

Because of these synergistic effects, the coefficient of performance of the heat exchanger unit 1 overall improves also when the heat exchanger unit 1 is used as a condenser.

II: Second Embodiment

Figure 2:
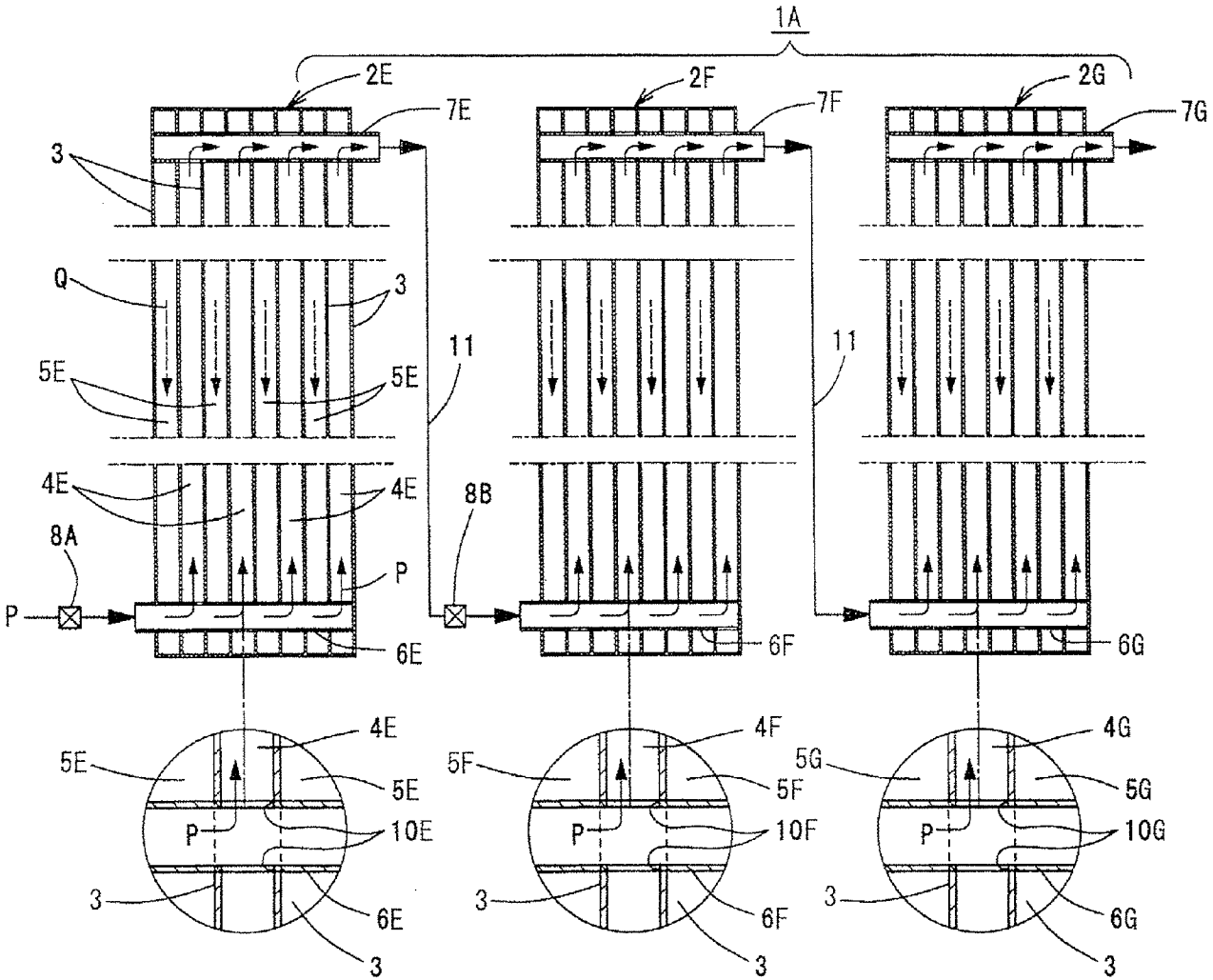
FIG. 2 is an explanatory diagram showing the structure of a heat exchanger unit pertaining to a second embodiment of the present invention.

FIG. 2 shows a heat exchanger unit 1A pertaining to a second embodiment of the present invention. This heat exchanger unit 1A is, like the heat exchanger unit 1 pertaining to the first embodiment, used as a utilization-side heat exchanger of a water-cooled chiller unit and is configured as a result of three plate heat exchangers 2E to 2G being sequentially interconnected in series by a connection conduit 11.

II-a: Configuration of Plate Heat Exchangers

The structure of the plate heat exchangers 2E to 2G is basically the same as that of each of the plate heat exchangers 2A to 2D in the first embodiment. What differs is the configuration of the portions pertaining to the distributivity of the refrigerant. That is, the plate heat exchanger 2E is equipped with plural refrigerant flow paths 4E, plural water flow paths 5E, a lower header portion 6E, an upper header portion 7E, and refrigerant inflow ports 10E. The plate heat exchanger 2F is equipped with plural refrigerant flow paths 4F, plural water flow paths 5F, a lower header portion 6F, an upper header portion 7F, and refrigerant inflow ports 10F. The plate heat exchanger 2G is equipped with plural refrigerant flow paths 4G, plural water flow paths 5G, a lower header portion 6G, an upper header portion 7G, and refrigerant inflow ports 10G.

In this embodiment, first, the refrigerant inflow ports 10E to 10G disposed in the lower header portions 6E to 6G and in the upper header portions 7E to 7G of each of the plate heat exchangers 2E to 2G are all set to a maximum diameter (that is, these refrigerant inflow ports 10E to 10G do not have the function of raising the distributivity of the refrigerant with respect to each of the refrigerant flow paths 4E to 4G of each of the plate heat exchangers 2E to 2G and the distributivity of the refrigerant between each of the plate heat exchangers 2E to 2G).

Second, in this embodiment, in association with the refrigerant inflow ports 10E to 10G of each of the plate heat exchangers 2E to 2G all being set to a maximum diameter as described above, orifices 8A and 8B are disposed in positions immediately before the lower header portions 6E and 6F of only the first plate heat exchanger 2E and the second plate heat exchanger 2F, and the degree of restriction of the orifice 8A of the first plate heat exchanger 2E is set higher than the degree of restriction of the orifice 8B of the second plate heat exchanger 2F.

II-b: Operation of Heat Exchanger Unit 1A

The heat exchanger unit 1A is used as an evaporator. In this case, in the first plate heat exchanger 2E, a gas-liquid two-phase refrigerant where the ratio of liquid refrigerant is the highest flows in from the lower header portion 6E thereof. The refrigerant P flowing into the lower header portion 6E is strongly restricted by the orifice 8A immediately before flowing into the first plate heat exchanger 2E, whereby gas-liquid mixing of the refrigerant P is promoted, and the refrigerant P flows into the first plate heat exchanger 2E from the lower header portion 6E in a state where gas refrigerant and liquid refrigerant are intermixed as homogenously as possible. Moreover, the refrigerant P travels through each of the refrigerant inflow ports 10E, and refrigerant where the mixing ratio of gas refrigerant and liquid refrigerant is the same ratio flows into each of the refrigerant flow paths 4E, whereby heat exchange with the water Q in promoted in the entire region, and high heat exchange performance is obtained. In other words, the orifice 8A is part of a gas-liquid mixing structure or means.

In the second plate heat exchanger 2F, the refrigerant P flowing into the second plate heat exchanger 2F is a gas-liquid two-phase refrigerant where the ratio of liquid refrigerant is lower than that of the refrigerant P flowing into the first plate heat exchanger 2E, so the gas-liquid equality of the refrigerant P (the characteristic that refrigerant where the mixing ratio of gas refrigerant and liquid refrigerant (e.g., where gas refrigerant is 80%, etc.) is the same ratio is distributed to each of the refrigerant flow paths) is intrinsically higher than in the case on the first plate heat exchanger 2E side, and gas-liquid mixing to the extent in the first plate heat exchanger 2E is not required. Consequently, the degree of restriction of the orifice 8B (part of a gas-liquid mixing structure or means) disposed in this second plate heat exchanger 2F is set lower than the degree of restriction of the orifice 8A disposed in the first plate heat exchanger 2E, whereby refrigerant distributivity that is equivalent to that in the first plate heat exchanger 2E is ensured, heat exchange with the water Q is promoted in the entire region, and high heat exchange performance is obtained.

In the third plate heat exchanger 2G, the refrigerant P flowing into the third plate heat exchanger 2G is made into a gas-liquid two-phase refrigerant where the ratio of gas refrigerant is the highest, so the gas-liquid equality of the refrigerant P is higher than in the case on the second plate heat exchanger 2F side. Consequently, refrigerant distributivity that is equivalent to that in the first plate heat exchanger 2E and in the second plate heat exchanger 2F is ensured even without disposing an orifice, heat exchange with the water Q is promoted in the entire region, and high heat exchange performance is obtained.

Because of the above synergistic effects, a high coefficient of performance is obtained in the heat exchanger unit 1A overall when the heat exchanger unit 1A is used as an evaporator.

Regarding configurations and action and effects other than those described above, the reader will be referred to the corresponding descriptions in the first embodiment, and description here will be omitted.

III: Third Embodiment

Figure 3:
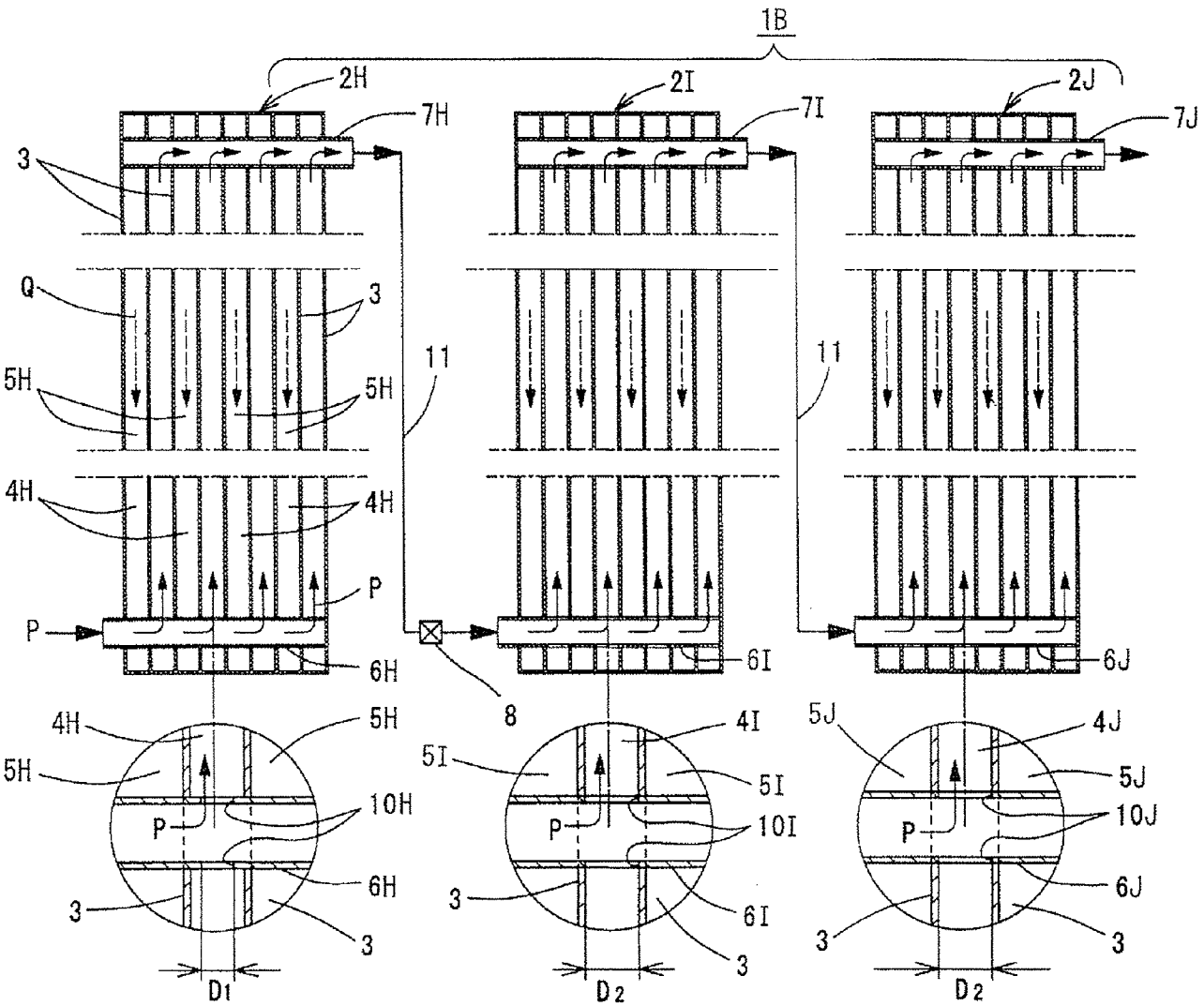
FIG. 3 is an explanatory diagram showing the structure of a heat exchanger unit pertaining to a third embodiment of the present invention.

FIG. 3 shows a heat exchanger unit 1B pertaining to a third embodiment of the present invention. This heat exchanger unit 1B is, like the heat exchanger unit 1A pertaining to the second embodiment, used as a utilization-side heat exchanger of a water-cooled chiller unit and is configured as a result of three plate heat exchangers 2H to 2J being sequentially interconnected in series by a connection conduit 11.

III-a: Configuration of Plate Heat Exchangers

The structure of the plate heat exchangers 2H to 2J is basically the same as that of each of the plate heat exchangers 2A to 2D in the first embodiment. What differs is the configuration of the portions pertaining to the distributivity of the refrigerant. The plate heat exchanger 2H is equipped with plural refrigerant flow paths 4H, plural water flow paths 5H, a lower header portion 6H, an upper header portion 7H, and refrigerant inflow ports 10H. The plate heat exchanger 2I is equipped with plural refrigerant flow paths 4I, plural water flow paths 5I, a lower header portion 6I, an upper header portion 7I, and refrigerant inflow ports 10I. The plate heat exchanger 2J is equipped with plural refrigerant flow paths 4J, plural water flow paths 5J, a lower header portion 6J, an upper header portion 7J, and refrigerant inflow ports 10J.

Specifically, high refrigerant distributivity is ensured by combining a restriction action resulting from an orifice 8 with a restriction action resulting from the refrigerant inflow ports 10H disposed in the lower header portion 6H and in the upper header portion 7H.

That is, in this embodiment, first, the refrigerant inflow ports 10H to 10J disposed in the lower header portions 6H to 6J and in the upper header portions 7H to 7J of each of the plate heat exchangers 2H to 2J are set to a diameter D1 in the first plate heat exchanger 2H and are set to a maximum diameter D2 (D2>D1) that does not have a restriction action both in the second plate heat exchanger 2I and in the third plate heat exchanger 2J.

Second, in this embodiment, in association with the refrigerant inflow ports 10H to 10J of each of the plate heat exchangers 2H to 2J being set as described above, the orifice 8 is disposed in a position immediately before the lower header portion 6I of only the second plate heat exchanger 2I, where the ratio of liquid refrigerant is positioned between that of the refrigerant P flowing into the first plate heat exchanger 2H and that of the refrigerant P flowing into the third plate heat exchanger 2J, and the degree of restriction of the orifice 8 is set lower than the degree of restriction resulting from the refrigerant inflow ports 10H in the first plate heat exchanger 2H.

III-b: Operation of Heat Exchanger Unit 1B

The heat exchanger unit 1B is used as an evaporator. In this case, in the first plate heat exchanger 2H, a gas-liquid two-phase refrigerant where the ratio of liquid refrigerant is the highest flows in from the lower header portion 6H thereof. The diameter of the refrigerant inflow ports 10H disposed in the lower header portion 6H is small, so when the refrigerant P flowing into this lower header portion 6H travels from the lower header portion 6H through the refrigerant inflow ports 10H and flows into each of the refrigerant flow paths 4H, gas-liquid mixing of the refrigerant P is promoted by the strong restriction action of the refrigerant inflow ports 10H, the refrigerant P flows into each of the refrigerant flow paths 4H in as equal a state as possible, and heat exchange with the water Q while the refrigerant P flows through each of the refrigerant flow paths 4H is promoted.

In the second plate heat exchanger 2I, the refrigerant P where the ratio of liquid refrigerant is lower (in other words, where the ratio of gas refrigerant is higher) than in the case of the first plate heat exchanger 2H flows into the second plate heat exchanger 2I from the lower header portion 6I side, so equal distribution to each of the refrigerant flow paths 4I is made possible even though the refrigerant distribution performance is lower than in the case of the first plate heat exchanger 2H. For this reason, in this embodiment, the orifice 8 whose degree of restriction is set lower than that of the refrigerant inflow ports 10H in the first plate heat exchanger 2H is disposed immediately before the second plate heat exchanger 2I, gas-liquid mixing of the refrigerant P is promoted by the restriction action of the orifice 8, the refrigerant P is caused to flow into the lower header portion 6I, the refrigerant P is caused to flow from the lower header portion 6I into each of the refrigerant flow paths 4I in as equal a state as possible, and heat exchange with the water Q while the refrigerant P flows through each of the refrigerant flow paths 4I is promoted.

In the third plate heat exchanger 2J, the refrigerant P flowing into the third plate heat exchanger 2J is a gas-liquid two-phase refrigerant where the ratio of the gas refrigerant is the highest, so the refrigerant P can be caused to flow into each of the refrigerant flow paths 4J in as equal a state as possible even without given a restriction function to the refrigerant inflow ports 10J. As a result, heat exchange with the water Q while the refrigerant P flows through each of the refrigerant flow paths 4J is promoted.

Because of the above synergistic effects, a high coefficient of performance is obtained in the heat exchanger unit 1B overall when the heat exchanger unit 1B is used as an evaporator.

Regarding configurations and action and effects other than those described above, the reader will be referred to the corresponding descriptions in the first and second embodiments, and description here will be omitted.

Further, in this embodiment, as described above, adjustment of the distribution function between each of the plate heat exchangers 2H to 2J is performed by combining adjustment of the diameter of the refrigerant inflow ports 10H to each of the refrigerant flow paths 4 from the lower header portion 6H disposed in the first plate heat exchanger 2H and adjustment of the amount of restriction of the orifice 8 disposed in the entrance of the second heat exchanger plate 2I. The former adjustment technique is effective particularly in the case of a gas-liquid two-phase refrigerant where the ratio of liquid refrigerant is high, because it works in each of the refrigerant flow paths 4H of the first plate heat exchanger 2H and has excellent equal distributivity of the refrigerant inside the first plate heat exchanger 2H. Further, the latter technique is particularly effective in the case of a gas-liquid two-phase refrigerant where the ratio of gas refrigerant is high, because its effect extends uniformly with respect to all of the refrigerant flow paths 4I of the second plate heat exchanger 2I. Thus, by combining both of these techniques in correspondence to the state of the refrigerant, a refrigerant distribution characteristic in which the merits of both techniques are effectively utilized is obtained. Therefore, a further improvement in the coefficient of performance in the heat exchanger unit 1B overall can be expected.

<Modifications>

In the preceding embodiment, a case where the orifice 8 is disposed in the second plate heat exchanger 2I has been described, but an orifice can also be disposed in the first plate heat exchanger 2H. In that case, when an orifice is disposed immediately before the lower header portion 6H of the first plate heat exchanger 2H, D2 is the diameter of the refrigerant inflow ports 10H of the plate heat exchanger 2H, and D5 is the diameter of the refrigerant inflow ports 10I of the plate heat exchanger 2I. The relationship between the diameter D2 and the diameter D5 is D5<D2. Further, the degree of restriction of the orifice is set higher than the degree of restriction resulting from the refrigerant inflow ports 10I in the first plate heat exchanger 2I.

Further, in the preceding embodiment, the diameter of the refrigerant inflow ports 10H of the second plate heat exchanger 2I is set to the same diameter D2 as the diameter of the refrigerant inflow ports 10J of the third plate heat exchanger 2J, but the diameter of the refrigerant inflow ports 10H can also be set to a diameter D6 that satisfies the relationship of D1<D6<D2. In that case, the degree of restriction of the orifice 8 is set lower than in the case of the third embodiment, so that the pressure loss in the second plate heat exchanger 2I becomes smaller than the pressure loss in the first plate heat exchanger 2H. In other words, the gas-liquid mixing structure(s) or means can also be configured by simultaneously using the mixing action of both the orifice and the refrigerant inflow ports.

IV: Fourth Embodiment

Figure 4:
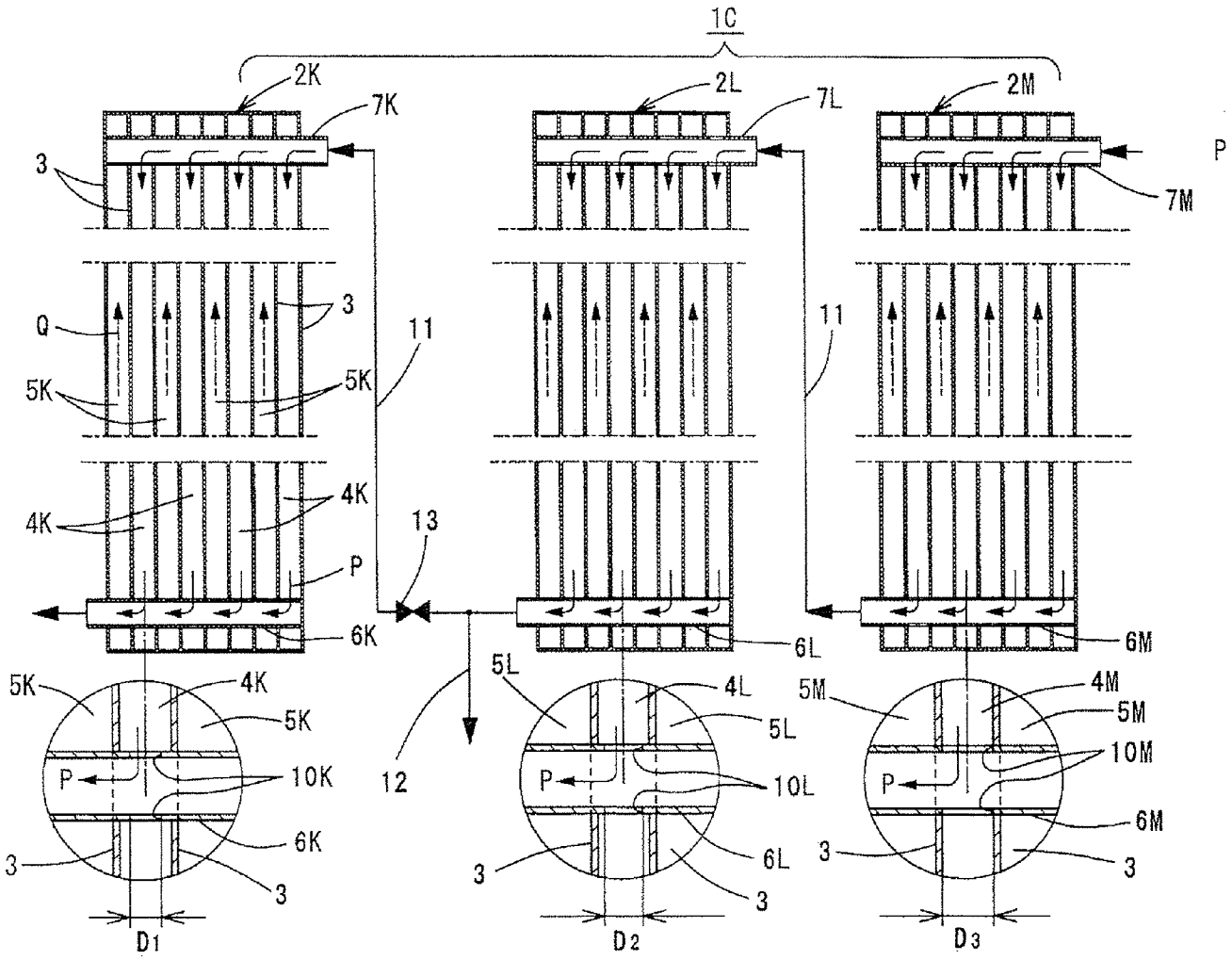
FIG. 4 is an explanatory diagram showing the structure of a heat exchanger unit pertaining to a fourth embodiment of the present invention.

FIG. 4 shows a heat exchanger unit 1C pertaining to a fourth embodiment of the present invention. This heat exchanger unit 1C is, like the heat exchanger unit 1 pertaining to the first embodiment, used as a utilization-side heat exchanger of a water-cooled chiller unit and is configured as a result of three plate heat exchangers 2K to 2M being sequentially interconnected in series by a connection conduit 11.

IV-a: Configuration of Plate Heat Exchangers

This heat exchanger unit 1C is, like in the case of the first embodiment, configured such that it can be reversibly used as either an evaporator or a condenser (FIG. 4 shows the flow of the refrigerant when the heat exchanger unit 1C is used as a condenser). The basic configuration of each of the plate heat exchangers 2K to 2M is made the same as that of each of the plate heat exchangers 2A to 2D in the first embodiment. That is, the plate heat exchanger 2K is equipped with plural refrigerant flow paths 4K, plural water flow paths 5K, a lower header portion 6K, an upper header portion 7K, and refrigerant inflow ports 10K. The plate heat exchanger 2L is equipped with plural refrigerant flow paths 4L, plural water flow paths 5L, a lower header portion 6L, an upper header portion 7L, and refrigerant inflow ports 10L. The plate heat exchanger 2M is equipped with plural refrigerant flow paths 4M, plural water flow paths 5M, a lower header portion 6M, an upper header portion 7M, and refrigerant inflow ports 10M.

D1 is the diameter of the refrigerant inflow ports 10K disposed in the lower header portion 6K and in the upper header portion 7K of the first plate heat exchanger 2K, which is positioned on the most-upstream side when the heat exchanger unit 1C is used as an evaporator (the most-downstream side when the heat exchanger unit 1C is used as a condenser). D2 is the diameter of the refrigerant inflow ports 10L disposed in the lower header portion 6L and in the upper header portion 7L of the second plate heat exchanger 2L, which is second from the most-upstream side. Moreover, D3 is the diameter of the refrigerant inflow ports 10M disposed in the lower header portion 6M and in the upper header portion 7M of the third plate heat exchanger 2M, which is positioned on the most-downstream side (the most-upstream side when the heat exchanger unit 1C is used as a condenser). Each of these diameters D1 to D3 is relatively set such that D1<D2<D3. In this case, the diameter D3 of the refrigerant inflow ports 10M of the third plate heat exchanger 2M is set to diameters that is the same as the width dimension of the refrigerant flow paths 4M. Consequently, the function of restricting refrigerant is not given to these refrigerant inflow ports 10M.

Moreover, from the standpoint of avoiding excessive pressure loss when the heat exchanger unit 1C is used as a condenser, a closing valve 13 is disposed in the connection conduit 11 interconnecting the first plate heat exchanger 2K and the second plate heat exchanger 2L, a bypass conduit 12 that bypasses the first plate heat exchanger 2K is disposed between the closing valve 13 and the lower header portion 6L of the second plate heat exchanger 2L, and the closing valve 13 is closed when the heat exchanger unit 1C is used as a condenser.

In this embodiment, the refrigerant inflow ports 10M of the third plate heat exchanger 2M are set to a diameter that is the same as the width dimension of the refrigerant flow paths 4M. Consequently, the function of restricting refrigerant is not given to these refrigerant inflow ports 10M.

IV-b: Operation of Heat Exchanger Unit 1C

IV-b-1: When Used as an Evaporator

In this case, the refrigerant P flows in the opposite direction of the flow direction shown in FIG. 1. That is, the refrigerant P flows into the first plate heat exchanger 2K from the lower header portion 6K side thereof, travels through each of the refrigerant flow paths 4K, flows out from the upper header portion 7K, and flows into the lower header portion 6L side of the second plate heat exchanger 2L via the connection conduit 11. The refrigerant P repeats this flow configuration from the second plate heat exchanger 2L to the third plate heat exchanger 2M until it finally flows out from the upper header portion 7M of the third plate heat exchanger 2M to a condenser (not shown) side.

Here, the distributivity of the refrigerant P in each of the plate heat exchangers 2K to 2M of the heat exchanger unit 1C will be considered. That is, the refrigerant P flows into the first plate heat exchanger 2K on the most-upstream side as a gas-liquid two-phase refrigerant where the ratio of liquid refrigerant is large, travels to the third plate heat exchanger 2M on the most-downstream side while progressively evaporating, and flows out from the third plate heat exchanger 2M as a gas-liquid two-phase refrigerant where the ratio of gas refrigerant is large. Consequently, the state of the refrigerant in each of the plate heat exchangers 2K to 2M differs.

In this case, in the heat exchanger unit 1C of this embodiment, as described above, the diameters of the refrigerant inflow ports 10K to 10M are set such that they sequentially become larger from the first plate heat exchanger 2K to the third plate heat exchanger 2M, so optimum refrigerant distributivity is obtained in each of the plate heat exchangers 2K to 2M. As a result, the coefficient of performance of the heat exchanger unit 1C overall improves.

That is, in the first plate heat exchanger 2K, a gas-liquid two-phase refrigerant where the ratio of liquid refrigerant is the largest flows in from the lower header portion 6K side, but because the diameter of the refrigerant inflow ports 10K disposed in the lower header portion 6K is small, the refrigerant P that travels from the lower header portion 6K through the refrigerant inflow ports 10K and flows into each of the refrigerant flow paths 4K becomes equalized as a result of being subjected to a strong gas-liquid mixing action when the refrigerant P flows in from the refrigerant inflow ports 10K, and heat exchange with the water Q while the refrigerant P flows through each of the refrigerant flow paths 4K is promoted.

Evaporation of the refrigerant P progresses while the refrigerant P travels from the first plate heat exchanger 2K to the second plate heat exchanger 2L and then to the third plate heat exchanger 2M on the most-downstream side. The ratio of gas refrigerant in the refrigerant P gradually increases, the flow rate of the refrigerant P increases because of the increase in the volume of the refrigerant P, and inherently the pressure loss tends to increase as the volume of the refrigerant P increases.

However, in this embodiment, an increase in the pressure loss is suppressed because the diameters of the refrigerant inflow ports 10L and 10M are set such that they become larger from the second plate heat exchanger 2L to the third plate heat exchanger 2M. Moreover, the ratio of gas refrigerant in the refrigerant P is large, and the distributivity of the refrigerant P to each of the refrigerant flow paths 4L to 4M of each of the plate heat exchangers 2L to 2M is maintained high.

Because of these synergistic effects, the coefficient of performance of the heat exchanger unit 1C overall improves when the heat exchanger unit 1C is used as an evaporator.

IV-b-2: When Used as a Condenser

When the heat exchanger unit 1C is used as a condenser, the refrigerant P flows in the direction shown in FIG. 1, but because the closing valve 13 is closed, the refrigerant P flows into the third plate heat exchanger 2M from the upper header portion 7M side thereof, travels through each of the refrigerant flow paths 4M, flows out from the lower header portion 6M, flows into the upper header portion 7L side of the second plate heat exchanger 2L via the connection conduit 11, travels through each of the refrigerant flow paths 4L, and flows out to the bypass conduit 12 side from the lower header portion 6L.

That is, when the heat exchanger unit 1C is used as a condenser, the first plate heat exchanger 2K is not used. This is because, in the first plate heat exchanger 2K, the diameter of the refrigerant inflow ports 10K is small, and when a gas-liquid two-phase refrigerant where the ratio of liquid refrigerant is large flows into the first plate heat exchanger 2K, the pressure loss becomes larger, so only the second plate heat exchanger 2L and the third plate heat exchanger 2M, in which the pressure loss does not greatly affect heat exchange performance, are used. In this manner, when the first plate heat exchanger 2K is not used, the heat exchange capacity of the heat exchanger unit 1C overall drops, but the pressure loss that accompanies the use of the first plate heat exchanger 2K disappears, so contrasting both of these, trouble does not arise because the coefficient of performance of the heat exchanger unit 1C relatively improves.

<Modifications>

In the preceding embodiment, a case where the diameters of the refrigerant inflow ports 10K to 10M are changed as the gas-liquid mixing structure(s) or means that performs adjustment of the distribution function or the pressure loss in the first plate heat exchanger 2K to the third plate heat exchanger 2M has been described, but, like in the second embodiment and in the third embodiment, an orifice can also be used as a part of a gas-liquid mixing structure(s) or means that performs adjustment of the distribution function or the pressure loss.

What is claimed is:

1. A heat exchanger unit comprising:

a first plate heat exchanger; and a second plate heat exchanger disposed in series along a predetermined flow direction relative to the first plate heat exchanger, with the first and second plate heat exchangers of the heat exchanger unit being configured and arranged such that a refrigerant flows from the first plate heat exchanger to the second plate heat exchanger when the heat exchanger unit operates as an evaporator to heat the refrigerant, and the refrigerant flows from the second plate heat exchanger to the first plate heat exchanger when the heat exchanger unit operates as a condenser to cool the refrigerant, the first plate heat exchanger having a plurality of first refrigerant flow paths, a plurality of first upper refrigerant inflow ports, a plurality of first water flow paths, a first lower header portion and a first upper header portion arranged and configured to distribute and collect the refrigerant that flows to the plurality of first refrigerant flow paths and causing the refrigerant to flow in the predetermined flow direction, and a first gas-liquid mixing structure arranged and configured to promote gas-liquid mixing of the refrigerant in the first lower header portion when the heat exchanger unit heats the refrigerant, the second plate heat exchanger having a plurality of second refrigerant flow path, a plurality of second upper refrigerant inflow ports, a plurality of second water flow paths, a second lower header portion and a second upper header portion arranged and configured to distribute and collect the refrigerant that flows to the plurality of second refrigerant flow paths and causing the refrigerant to flow in the predetermined flow direction, and a second gas-liquid mixing structure arranged and configured to promote gas-liquid mixing of the refrigerant in the second lower header portion when the heat exchanger unit heats the refrigerant, and the first gas-liquid mixing structure and the second gas-liquid mixing structure being configured such that pressure loss becomes larger when the gas-liquid mixing action becomes higher and being configured such that the gas-liquid mixing action of the first gas-liquid mixing structure is higher than the gas-liquid mixing action of the second gas-liquid mixing structure, the first gas-liquid mixing structure including a plurality of first lower refrigerant inflow ports disposed in connecting portions between the plurality of first refrigerant flow paths and the first lower header portion, the second gas-liquid mixing structure including a plurality of second lower refrigerant inflow ports disposed in connecting portions between the plurality of second refrigerant flow paths and the second lower header portion, the first plate heat exchanger and the second plate heat exchanger being configured such that the first lower refrigerant inflow ports have smaller diameters than the second lower refrigerant inflow ports, and each of the first refrigerant flow paths communicates with one of the first upper refrigerant inflow ports and one of the first lower refrigerant inflow ports, and each of the second refrigerant flow paths communicates with one of the second upper refrigerant inflow ports and one of the second lower refrigerant inflow ports such that the refrigerant that travels through the plurality of first lower refrigerant inflow ports flows into the plurality of first refrigerant flow paths, is subjected to a gas-liquid mixing action to promote heat exchange with water in the plurality of first water flow paths and then travels through the plurality of first upper refrigerant inflow ports when the heat exchanger unit operates as an evaporator to heat the refrigerant, and the refrigerant that travels through the plurality of second lower refrigerant inflow ports flows into the plurality of second refrigerant flow path, is subjected to a gas-liquid mixing action to promote heat exchange with water in the plurality of second water flow paths and then travels through the plurality of second upper refrigerant inflow ports when the heat exchanger unit operates as an evaporator to heat the refrigerant.

2. The heat exchanger unit according to claim 1, further comprising a third plate heat exchanger disposed in series along the predetermined flow direction relative to the second plate heat exchanger, the third plate heat exchanger having a plurality of third refrigerant flow paths, a third lower header portion and a third upper header portion arranged and configured to distribute and collect the refrigerant that flows to the plurality of third refrigerant flow paths and causing the refrigerant to flow in the predetermined flow direction, and a third gas-liquid mixing structure having a plurality of third refrigerant inflow ports disposed in connecting portions between the plurality of third refrigerant flow paths and the third lower header portion, and the first plate heat exchanger, the second plate heat exchanger, and the third plate heat exchanger are configured such that the first refrigerant inflow ports have smaller diameters than the second refrigerant inflow ports and such that the second refrigerant inflow ports have smaller diameters than the third refrigerant inflow ports.

3. The heat exchanger unit according to claim 2, further comprising a bypass conduit arranged and configured to bypass the first plate heat exchanger when the heat exchanger unit functions as a condenser and to not bypass the first plate heat exchanger when the heat exchanger unit functions as an evaporator.

4. The heat exchanger unit according to claim 1, wherein the first gas-liquid mixing structure includes a plurality of first refrigerant inflow ports disposed in connecting portions between the plurality of first refrigerant flow paths and the first lower header portion, the second plate heat exchanger has an orifice arranged and configured to adjust the refrigerant that flows into the second lower header portion, and the first plate heat exchanger and the second plate heat exchanger are configured such that the first refrigerant inflow ports become more restricted than the orifice.

5. The heat exchanger unit according to claim 4, further comprising a bypass conduit arranged and configured to bypass the first plate heat exchanger when the heat exchanger unit functions as a condenser and to not bypass the first plate heat exchanger when the heat exchanger unit functions as an evaporator.

6. The heat exchanger unit according to claim 1, further comprising a bypass conduit arranged and configured to bypass the first plate heat exchanger when the heat exchanger unit functions as a condenser and to not bypass the first plate heat exchanger when the heat exchanger unit functions as an evaporator.

* * * * *

UNITED STATES PATENT AND TRADEMARK OFFICE

CERTIFICATE OF CORRECTION

PATENT NO. : 8,671,714 B2
APPLICATION NO. : 12/937998
DATED : March 18, 2014
INVENTOR(S) : Yasuhiro Kondou It is certified that error appears in the above-identified patent and that said Letters Patent is hereby corrected as shown below:

In the Claims

In Column 17, line 40, change “path,” to --paths,--

Signed and Sealed this
Twentieth Day of January, 2015

Michelle K. Lee

Michelle K. Lee
*Deputy Director of the United States Patent and Trademark Office*